US005560185A

United States Patent [19]

Petkovsek

[11] Patent Number: 5,560,185

[45] Date of Patent: Oct. 1, 1996

[54] SYSTEM AND METHOD FOR SEALING A FLAPLESS ENVELOPE

[75] Inventor: Glenn Petkovsek, 20 Tortoise Park Cove, Little Rock, Ark. 72211-2349

[73] Assignee: Glenn Petkovsek, Little Rock, Ark.

[21] Appl. No.: 425,427

[22] Filed: Apr. 20, 1995

[51] Int. Cl.[6] ..... B65B 11/48

[52] U.S. Cl. ..... 53/460; 53/284.3; 53/569

[58] Field of Search ..... 53/460, 492, 569, 53/284.3, 381.5, 386.1, 375.4; 156/92, 291, 578, 442.2; 493/132, 336, 337

[56] References Cited

U.S. PATENT DOCUMENTS

| | | | |
|---|---|---|---|
| 3,478,409 | 11/1969 | Votaw et al. | 156/92 |
| 4,033,807 | 7/1977 | Neil et al. | 156/442.2 |
| 4,567,711 | 2/1986 | Hodnett et al. | 53/136.5 |
| 4,951,864 | 8/1990 | Dicker | 229/80 |
| 5,007,371 | 4/1991 | O'Dea et al. | 156/442.2 |
| 5,097,654 | 3/1992 | Latsounas et al. | 53/284.3 |
| 5,125,214 | 6/1992 | Orsinger et al. | 53/284.3 |
| 5,301,935 | 4/1994 | Miki et al. | 53/284.3 |

FOREIGN PATENT DOCUMENTS

| | | | |
|---|---|---|---|
| 0914287 | 1/1963 | United Kingdom | 493/336 |

*Primary Examiner*—John Sipos
*Assistant Examiner*—Gene Kim
*Attorney, Agent, or Firm*—Hill, Steadman & Simpson

[57] ABSTRACT

A system and a method for sealing a flapless envelope are provided. The sealing system has a translating station for moving the flapless envelope via a conveyor, an opening station for opening an end of a flapless envelope by means of suction and a sealing station for moistenable adhesive on the flapless envelope to thereby seal the flapless envelope. The method has the steps of lifting a top sheet of the flapless envelope using a plurality of suction tubes, holding a bottom sheet of the flapless envelope using a suction controlled bottom plate, applying a fluid onto an adhesive on the bottom sheet of the flapless envelope and squeezing the top sheet to the bottom sheet to seal the flapless envelope.

13 Claims, 3 Drawing Sheets

106
42
40
12
50
52
56
54
16
62
VII
60
64
66
74
32
26
18
14
36
38
30
34
A
B
20
22
24
10
D
E
F
105
72
94
78

SYSTEM AND METHOD FOR SEALING A FLAPLESS ENVELOPE

BACKGROUND OF THE INVENTION

The present invention generally relates to a system and method for sealing a mailing article. More specifically, the present invention relates to a system and method for sealing a flapless envelope.

It is generally known to provide a system for automatically sealing an envelope. For example, U.S. Pat. No. 4,951,864 to Dicker discloses an apparatus for folding and sealing a mailer blank that includes a water applicator for activating remoistenable glue strips on the mailer blank prior to folding it to form an envelope. Glue is disposed along the longitudinal edges as well as the transverse edge of the mailer and one mailer section forms a flap with glue for sealing the mailer. To this end, Dicker also discloses applying the water by using water reservoirs having tubes to deliver the water from the reservoir to an applicator. Dicker discloses using a rotatably mounted wheel capable of picking up water from the reservoir for application to the underside of the blank. Alternatively, an applicator may be a brush that extends upwardly from the reservoir or a nozzle that uses gravity fed water to moisten the delivery.

However, Dicker discloses an envelope that has a flap with a contoured closing portion that must be folded to seal the envelope. Thus, another time consuming folding step must be performed to seal the mailer. In addition, the folding devices are often costly and add another step to the process of sealing the envelope.

To avoid the extra folding step involved with using an envelope having a flap, the inventor herein has developed a flapless envelope. Co-pending patent application U.S. Ser. No. 08/398,747 discloses a flapless envelope. Such an envelope is provided with an adhesive on an inner portion of the envelope and does not have a flap. Thus, the disadvantage of adding costly folding equipment to the process of sealing the envelope can be avoided if a flapless envelope is used as disclosed in the co-pending application referenced above.

A need, therefore, has arisen for a system and a method for sealing a flapless envelope to minimize the steps involved in the process by reducing the devices needed to seal the envelope.

SUMMARY OF THE INVENTION

The present invention provides a method and an apparatus for sealing a flapless envelope in which the method simplifies the sealing process and reduces the amount of equipment needed to seal the flapless envelope.

To this end, in an embodiment, a method is provided for sealing a flapless envelope. The method has the steps of opening a top ply of an open end of the flapless envelope; holding a lower ply of the open end of the flapless envelope, the lower ply having a moistenable adhesive area; spraying a mist of fluid onto the moistenable adhesive area of the bottom ply of the flapless envelope; and squeezing the top ply and the bottom ply of the open end of the flapless envelope to seal the flapless envelope.

In an embodiment, the method further comprises the step of using at least one sucker tube to open a top ply of an open end of a flapless envelope.

In an embodiment, the method further comprises the step of using a bottom plate having at least one sucker hole to hold the lower ply of an open end of the flapless envelope.

In an embodiment, the method further comprises the step of using a bottom plate controlled by at least one suction tube to hold the lower ply of the open end of the flapless envelope.

In an embodiment, the method further comprises the step of using a bottom plate having a suction channel to hold the lower ply of the open end of the flapless envelope.

In an embodiment, the method further comprises the steps of providing the bottom plate with an adjustment means, and adjusting the bottom plate relative to the flapless envelope.

In an embodiment, the method further comprises the step of inserting a document into the open end of the flapless envelope before spraying a mist of fluid onto the moistenable adhesive area.

In an embodiment, the method further comprises the step of activating the moistenable adhesive to permanently seal the top ply to the bottom ply.

In an embodiment, the method further comprises the steps of automatically controlling a duration of the spraying step; and automatically directing the spraying step to accurately locate the mist of fluid.

In an embodiment, the method further comprises the steps of providing a top roller and a bottom roller constructed and arranged to compress an item directed therebetween; and directing the top ply and the bottom ply of the open end of the flapless envelope between the top roller and the bottom roller to compress and seal the flapless envelope.

In an embodiment, the top roller and the bottom roller are constructed of metal.

In an embodiment, the method further comprises the step of heating the top roller and the bottom roller to simultaneously seal and dry the sprayed area of the flapless envelope.

In an embodiment, the top roller and the bottom roller are constructed of rubber.

In another embodiment of the present invention, a method is provided for sealing a flapless envelope having the steps of opening a top ply of an open end of the flapless envelope; holding a bottom ply of the open end of the flapless envelope, the bottom ply having a dry gum area; and penetrating the top ply and the bottom ply to allow a fluid onto the dry gum area.

In an embodiment, the method further comprises the steps of providing a needle roller having a supply of fluid capable of dispensing through the needle roller onto the bottom ply; and dispensing an amount of the supply of fluid through the needle roller onto the dry gum area of the bottom ply.

In an embodiment, the method further comprises the step of automatically controlling the timing and the placement of the penetrating step.

In another embodiment of the present invention, an apparatus is provided for sealing a flapless envelope. The apparatus includes means for opening a top ply of an open end of the flapless envelope; means for holding a lower ply of the open end of the flapless envelope, the lower ply having a moistenable adhesive area; means for moistening the moistenable adhesive area of the bottom ply of the flapless envelope; and means for squeezing the top ply and the bottom ply of the open end of the flapless envelope to seal the flapless envelope.

In an embodiment, the apparatus further comprises a plurality of sucker tubes constructed and arranged to open the top ply of the open end of the flapless envelope.

In an embodiment, the apparatus further comprises a bottom plate having a plurality of sucker holes interconnected by at least one suction channel constructed and arranged to hold the flapless envelope open.

In an embodiment, the apparatus further comprises means for adjusting the position of the holding means to adjust the degree to which the open end of the flapless envelope is held open.

In an embodiment, the apparatus further comprises a spray head connected to the moistening means to provide a spray mist of fluid onto the moistenable adhesive area of the bottom ply of the flapless envelope.

In an embodiment, the apparatus further comprises a controller connected to the moistening means to provide an automatically controlled spray mist onto the moistenable adhesive area of the bottom ply of the flapless envelope.

In an embodiment, the apparatus further comprises rubber rollers connected to the means for squeezing the top ply and the bottom ply of the open end of the flapless envelope to seal the flapless envelope.

In an embodiment, the apparatus further comprises metal rollers connected to the means for squeezing the top ply and the bottom ply of the open end of the flapless envelope to seal the flapless envelope.

In an embodiment, the apparatus further comprises heated rollers connected to the means for squeezing the top ply and the bottom ply of the open end of the flapless envelope to seal the flapless envelope, the heated rollers being capable of drying the moistenable adhesive area.

In an embodiment, the apparatus further comprises a wheel having needles capable of dispensing a fluid through the plurality of needles; and a pliable bottom roller in contact with the wheel.

In an embodiment, the apparatus further comprises a controller connected to the moistening means to control the dispensing of the fluid through the plurality of needles.

It is, therefore, an advantage of the present invention to provide an improved system and method for sealing an envelope.

And, another advantage of the present invention is to provide a system and an assembly that is integrally formed as a complete unit for sealing an envelope.

Yet another advantage of the present invention is to provide a system for sealing an envelope and a method for sealing an envelope without requiring additional adhesives.

Moreover, an advantage of the present invention is to provide a system for sealing an envelope and a method for sealing an envelope without requiring any folding of the envelope.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a system for sealing a flapless envelope. Further, the present invention provides a method for sealing a flapless envelope.

Figures 1, 7:
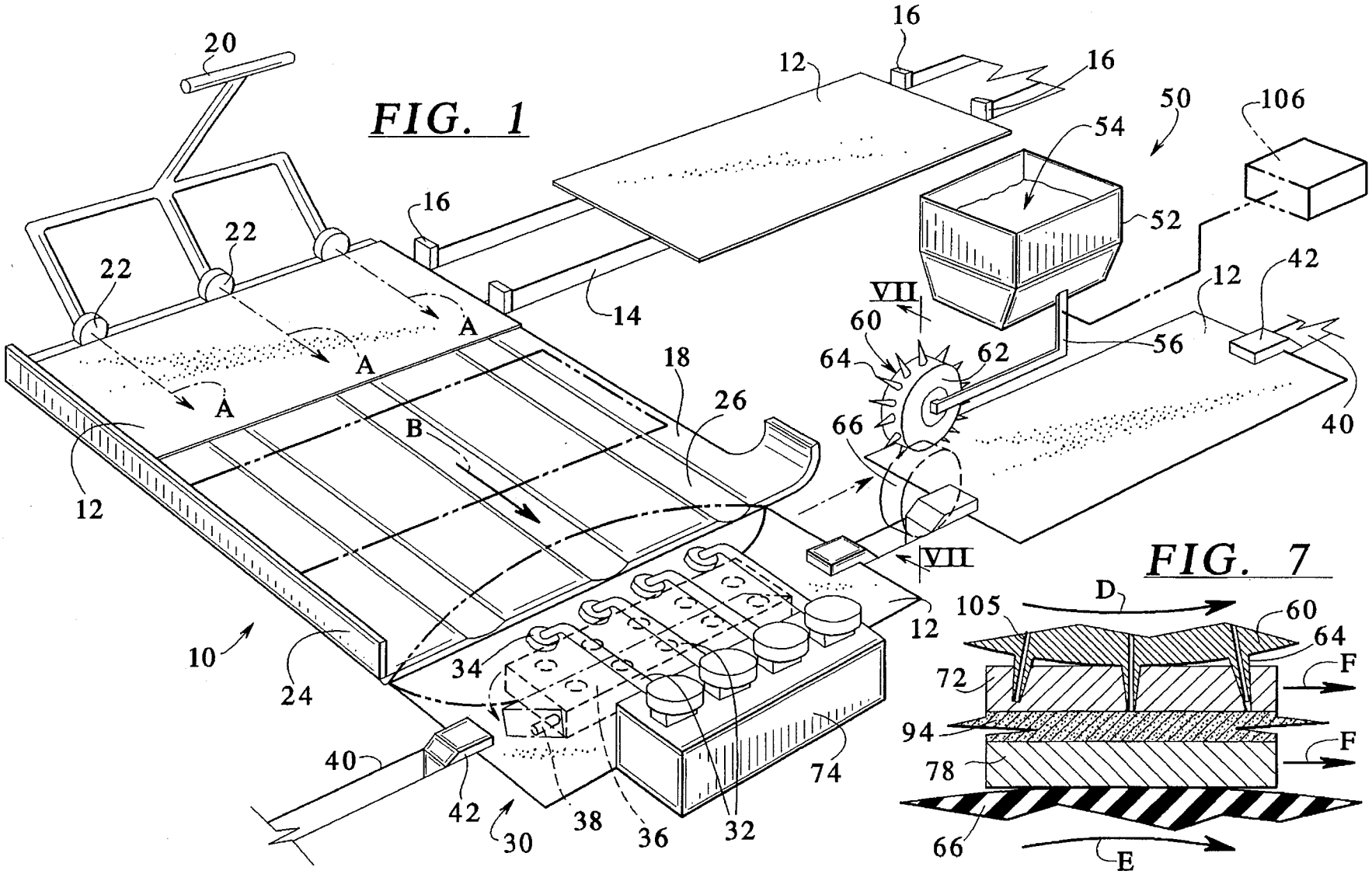
FIG. 1 illustrates a perspective view of an embodiment of the system of the present invention.
FIG. 7 illustrates a cross-sectional view of an embodiment of a needle roller of the present invention taken generally along the line VII—VII of FIG. 1.

Referring now to the drawings, wherein like numerals refer to like parts, FIG. 1 generally illustrates a system 10 for sealing a flapless envelope 12. In the embodiment illustrated, the flapless envelope 12 travels along a conveyor 14 having tabs 16 to guide the flapless envelope 12 throughout the system 10. A basic description of the component parts of the system 10, combined with an explanation of the method of sealing a flapless envelope using the system follows.

A transfer station 18 is provided at which the flapless envelope 12 that has been previously transported along the conveyor 14 is properly positioned for sealing the flapless envelope 12 using the system 10 of the present invention. A translating member 20 having a plurality of pads 22 is provided to change the direction of the flapless envelope 12 for subsequent sealing steps of the method of the present invention described below. Also, the transfer station 18 has a retaining wall 24 and pad grooves 26, in which the pads 22 travel, for guiding the flapless envelope 12 along arrows A in the direction of arrow B.

Figure 2:
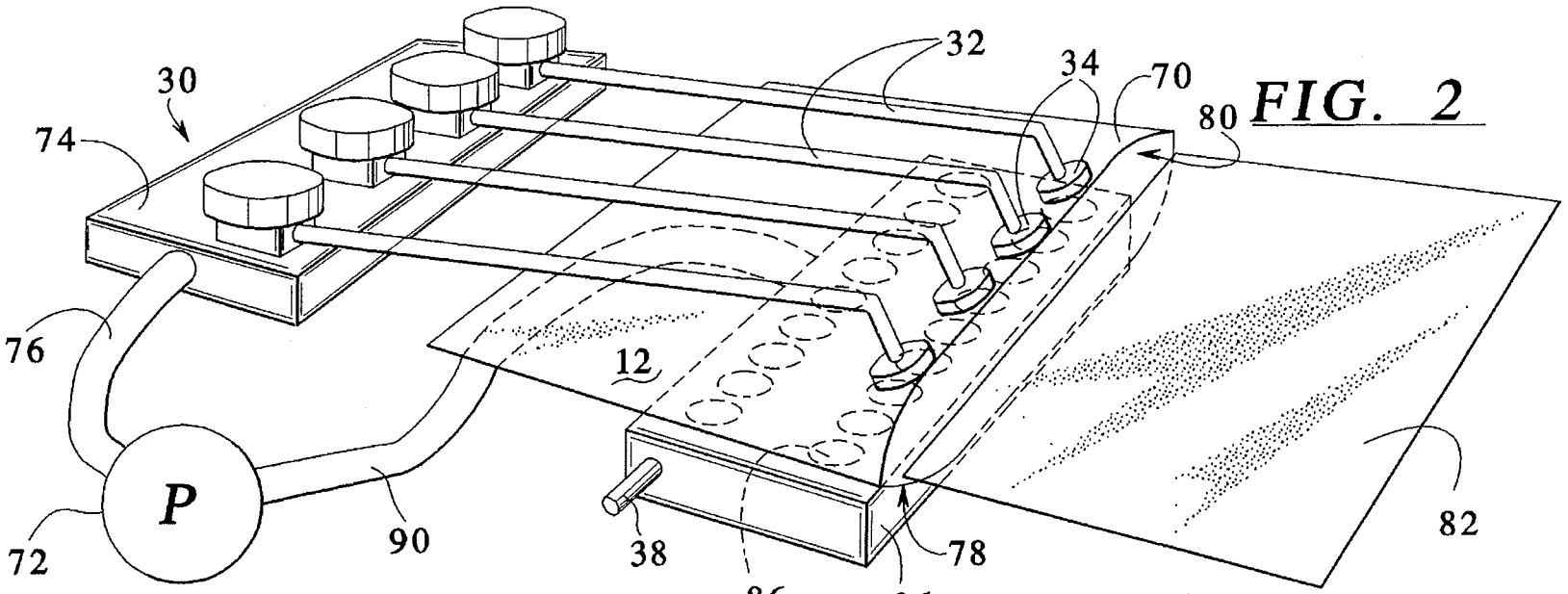
FIG. 2 illustrates a perspective view of a component of an embodiment of the system of the present invention.
Figure 4:
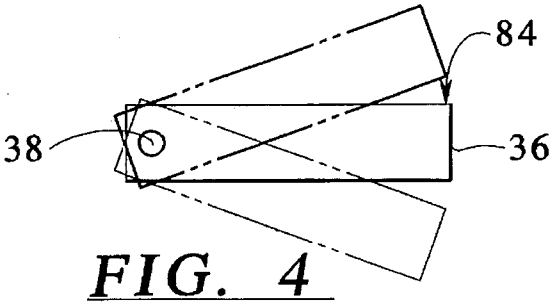
FIG. 4 illustrates a side view of an embodiment of a bottom plate of the system of the present invention showing a range of pivoting motion.
Figure 3:
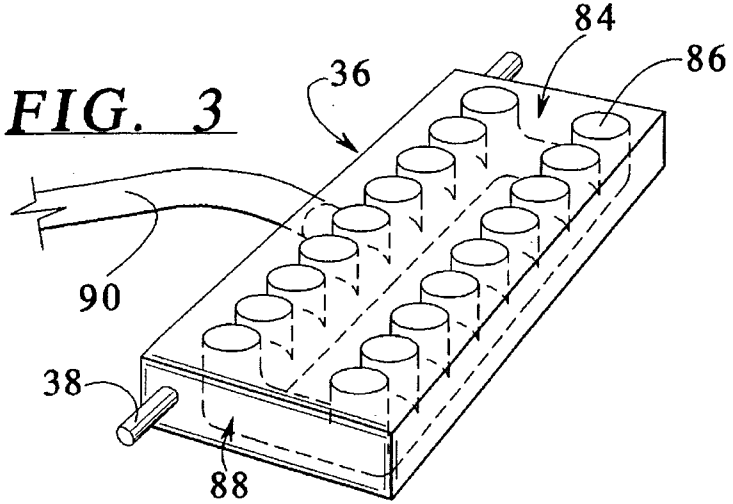
FIG. 3 illustrates a perspective view of an embodiment of a bottom plate of the system of the present invention.

In addition to the conveyor 14 and the transfer station 18, the system 10 of the present invention provides a flapless envelope opening station indicated generally at 30. The opening station 30 is also illustrated in FIG. 2 and described below. Various components of the opening station 30 include a plurality of suction tubes 32 having sucker ends 34 located at an end thereof. Also, a bottom suction plate 36 is illustrated generally beneath the suction tubes 32. An embodiment of the bottom suction plate 36 is also shown in FIG. 3. The bottom suction plate 36 also has a pivot rod 38 about which the bottom suction plate 36 can be rotated. Such rotation is performed to open the flapless envelope 12 to a wider degree. Also, the bottom suction plate 36 is illustrated in FIG. 4 showing the range of motion of the bottom suction plate 36.

Another conveyor 40 having tabs 42 is provided to transfer the flapless envelope 12 to a sealing station indicated generally at 50. In the embodiment illustrated in FIG. 1, this sealing station 50 has a reservoir 52 containing a moistening agent 54, preferably water or an adhesive fluid. The moistening agent 54 is capable of being dispensed through a tube 56 to a needle roller 60. The needle roller 60 comprises a wheel 62 having a plurality of fluid communicating needles 64 located at the circumference thereof. In addition, a roller wheel 66 is provided beneath the needle roller 60 so that the flapless envelope 12 travels between the needle roller 60 and the roller wheel 66.

FIG. 2 illustrates the opening station 30 of the system 10 of the present invention in greater detail. For example, the suction tubes 32 having sucker heads 34 located at the end thereof are shown lifting and holding a top sheet 70 of the flapless envelope 12. The sucker heads 34 are capable of providing ample holding suction by means of a suction pump 72 connected to a base member 74 of the opening station 30 via a tube 76.

Still referring to FIG. 2, the bottom suction plate 36 is located beneath the sucker pads 34. The bottom suction plate 36 is also shown in detail in FIG. 3 and described below. The bottom suction plate 36 holds a bottom sheet 78 of the flapless envelope 12. The bottom suction plate 36 can be rotated downward along the pivot rod 38 to thereby increase an opening 80 in the flapless envelope 12. When the opening 80 is of a sufficient width, a letter 82, for example, can be inserted therein. The letter 82 can be inserted manually or by using known automated inserters (not shown).

FIG. 3 illustrates an embodiment of the bottom suction plate 36 of the present invention. The bottom suction plate 36 has a top face 84 having a plurality of suction holes 86 distributed therein. The suction holes 86 are connected internally in the bottom suction plate 36 via a suction channel 88. The suction channel 88 is connected via a tube 90 to the suction pump 72 as shown in FIG. 2. In this manner, the bottom suction plate 36 is able to provide sufficient suction to hold the bottom sheet 78 of the flapless envelope 12.

FIG. 4 shows in detail the rotation possible by the bottom suction plate 36 as described above. As illustrated, the bottom suction plate 36 rotates about the pivot rod 38 in either direction.

Figures 5, 6:
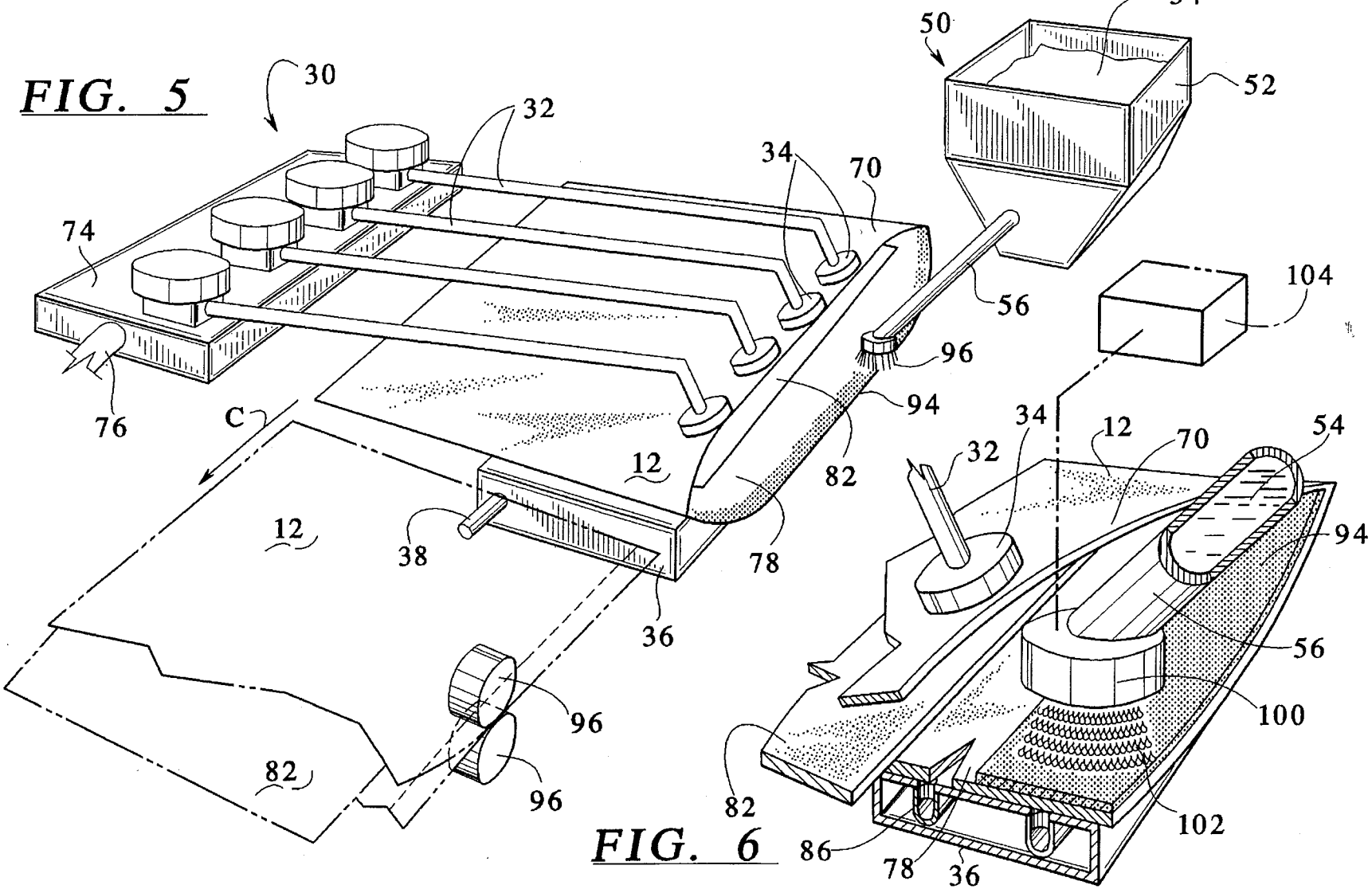
FIG. 5 illustrates a perspective view of various components of an embodiment of the system of the present invention.
FIG. 6 illustrates a perspective view in enlarged detail of a portion of an embodiment of the system of the present invention showing a step of the method of the invention.

FIG. 5 illustrates another embodiment of the sealing station 50 of the system 10 of the present invention. As illustrated therein, the flapless envelope 12 is held open to expose an adhesive portion 94 located at the outer extent of the bottom sheet 78 of the flapless envelope 12. The sealing station 50 has a moistening brush 96 which is in fluid communication with the moistening agent 54 in the reservoir 52 by means of the dispensing tube 56. The moistening brush 96 can thereby moisten the adhesive portion 94. After the adhesive portion 94 has been moistened by the moistening station 50, the flapless envelope 12 continues along in a direction of arrow C, so that a pair of sealing rollers 96 compress the top sheet 70 and the bottom sheet 78 together to seal the flapless envelope 12. The adhesive section 94 adheres both sheets 70, 78 to each other, thereby enclosing the letter 82 within the confines of the flapless envelope 12.

FIG. 6 illustrates yet another embodiment of the moistening station 50 of the present invention. In this embodiment, a spray head 100 is provided at the end of the tube 56. The spray head 100 generates a plurality of fluid droplets 102 to moisten the adhesive portion 94 located on the bottom sheet 78 of the flapless envelope 12. The duration and location of the spray head 100 can be controlled to avoid overspray or inadequate moistening of the adhesive portion 94. After the spray head 100 has moistened the adhesive strip 94, the flapless envelope 12 proceeds as in FIG. 5 through the pair of sealing rollers 96.

In a preferred embodiment, the pair of sealing rollers 96 are made of rubber or some other pliable material. However, in another embodiment, the pair of sealing rollers 96 may be constructed of metal or some other heat conductive material. The metal pair of sealing rollers 96 is heated in the method of the present invention so that the rolling motion of the pair of sealing rollers 96 seals the flapless envelope 12 and while the heat from the heated rollers 96 dries the plurality of fluid droplets 102 sprayed on by the spray head 100. In addition, the spray head 100 is connectable to an automatic controller 104 that regulates the duration and the location of the spray head 100.

FIG. 7 illustrates a cut away enlarged detail view of the needle roller 60 and the roller wheel 66 showing how the flapless envelope 12 is sealed using the method of the present invention. While the needle roller 60 is rotating counterclockwise as indicated by arrow D, the roller wheel 66 is rolling clockwise as indicated by arrow E. In addition the flapless envelope 12, having the top sheet 70 and the bottom sheet 78 and adhesive portion 94, travels in the direction of arrow F. In this manner, the plurality of needles 64, each having a needle vein 105 capable of dispensing the moistening agent 54 therethrough, come into contact with the flapless envelope 12.

The plurality of needles 64 puncture the top sheet 70 and provide the moistening agent 54 through the needle vein 104 to come in contact with the adhesive portion 94 of the bottom sheet 78, thereby moistening the adhesive portion 94 for sealing. The compression generated on the flapless envelope 12 by the needle roller 60 in combination with the roller wheel 66 squeezes the top sheet 70 to the bottom sheet 78 so that sealing is performed in one continuous motion.

Thus, it is preferred that the roller wheel 66 is made of rubber or a material that does not cause wear or blockage to the plurality of needles 64 on the needle roller 60. Also, the embodiment of the present invention which uses the needle rollers 60 and the roller wheel 66 in combination to seal the flapless envelope 12 can be connected with a controller 106 (see FIG. 1) to maintain the proper duration time and placement of the moistening step of the method of the present invention.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A method for sealing a flapless envelope, the method comprising the steps of:

opening a top ply of an open end of the flapless envelope;

holding a bottom ply of the open end of the flapless envelope wherein the bottom ply has a dry gum area and further wherein the bottom ply is sized substantially equal to the top ply; and penetrating the top ply and the bottom ply to allow a fluid onto the dry gum area; and providing a roller with a plurality of needle-like elements that protrude radially having a supply of fluid capable of dispensing through the roller onto the bottom ply; and dispensing an amount of the supply of fluid through the roller onto the dry gum area of the bottom ply.

2. The method of claim 1 further comprising the step of:

automatically controlling the timing and the placement of the penetrating step.

3. An apparatus for sealing a flapless envelope, the apparatus comprising:

opening means capable of opening a top ply of an open end of the flapless envelope;

holding means capable of holding a lower ply of the open end of the flapless envelope wherein the lower ply has a moistenable adhesive and further wherein the lower ply is sized substantially equal to the top ply;

moistening means capable of moistening the moistenable adhesive area of the bottom ply of the flapless envelope between the top ply and the bottom ply; and means for squeezing the top ply and the bottom ply of the open end of the flapless envelope at the moistenable adhesive area to seal the flapless envelope;

a roller having a plurality of needle-like elements that protrude radially having a fluid therein and capable of dispensing the fluid through the plurality of needle-like elements; and a pliable bottom roller in contact with the wheel.

4. The apparatus of claim 3 further comprising:

a plurality of sucker tubes constructed and arranged to open the top ply of the open end of the flapless envelope.

5. The apparatus of claim 3 further comprising:

a bottom plate having a plurality of sucker holes interconnected by at least one suction channel constructed and arranged to hold the flapless envelope open.

6. The apparatus of claim 3 further comprising:

means for adjusting the position of the holding means to adjust the degree to which the open end of the flapless envelope is held open.

7. The apparatus of claim 3 further comprising:

a spray head connected to the moistening means to provide a spray mist of fluid onto the moistenable adhesive area of the bottom ply of the flapless envelope.

8. The apparatus of claim 3 further comprising:

a controller connected to the moistening means to control spraying of the moistenable adhesive area.

9. The apparatus of claim 3 further comprising:

rubber rollers connected to the means for squeezing the top ply and the bottom ply of the open end of the flapless envelope to seal the flapless envelope.

10. The apparatus of claim 3 further comprising:

metal rollers connected to the means for squeezing the top ply and the bottom ply of the open end of the flapless envelope to seal the flapless envelope.

11. The apparatus of claim 3 further comprising:

heated rollers connected to the means for squeezing the top ply and the bottom ply of the open end of the flapless envelope to seal the flapless envelope, the heated rollers capable of drying the moistenable adhesive area.

12. The apparatus of claim 3 further comprising:

a wheel having needles capable of dispensing a fluid through the plurality of needles; and a pliable bottom roller in contact with the wheel.

13. A method for sealing a flapless envelope, the method comprising the steps of:

opening a top ply of an open end of the flapless envelope;

holding a bottom ply of the open end of the flapless envelope, wherein the bottom ply having a dry gum area;

penetrating the top ply and the bottom ply to allow a fluid onto the dry gum area;

providing a needle roller with a plurality of needle-like elements that protrude radially having a supply of fluid capable of dispensing through the needle roller onto the bottom ply; and dispensing an amount of the supply of fluid through the needle roller onto the dry gum area of the bottom ply.

* * * * *